United States Patent [19]

Willums

[11] 4,037,874

[45] July 26, 1977

[54] APPARATUS FOR UNDERWATER RETRIEVAL, SELECTION AND CONCENTRATION OF MATERIAL FOR OCEAN MINING

[75] Inventor: Jan-Olaf Willums, Sandvika, Norway

[73] Assignee: Nor-Am Resources Technology Incorporated, Boston, Mass.

[21] Appl. No.: 626,307

[22] Filed: Oct. 28, 1975

[51] Int. Cl.[2] ..... E02F 7/00

[52] U.S. Cl. ..... 299/8; 37/57; 37/66; 37/DIG. 8

[58] Field of Search ..... 299/8, 9; 37/195, DIG. 8, 37/55, 57, 58, 66, 56

[56] References Cited

U.S. PATENT DOCUMENTS

| | | | |
|---|---|---|---|
| 2,722,759 | 11/1955 | Cosenza | 37/66 |
| 3,480,326 | 11/1969 | Sheary et al. | 299/8 |
| 3,521,387 | 7/1970 | Degelman | 37/66 |
| 3,556,598 | 1/1971 | Smith | 299/8 |
| 3,697,134 | 10/1972 | Murray | 299/8 |
| 3,740,098 | 6/1973 | Lachnit | 299/8 |
| 3,905,137 | 9/1975 | Gee | 37/66 X |

*Primary Examiner*—Clifford D. Crowder

*Attorney, Agent, or Firm*—Rines and Rines, Shapiro and Shapiro

[57] ABSTRACT

Underwater mining apparatus employs a rotatable drum having a plurality of rows of digging forks and a plurality of adjacent rows of openings for receiving materials loosened by the forks during rotation of the drum over the ocean bottom. The spacing between the forks determines the minimum size of material to be mined and the size of the openings determines the maximum size. A material-receiving trough extends longitudinally along the interior of the drum and communicates with the openings. A longitudinally extending spiral screw rotates with the drum within the trough to concentrate the material and to move the material longitudinally to a pick-up region, from which the material is transported hydraulically.

4 Claims, 1 Drawing Figure

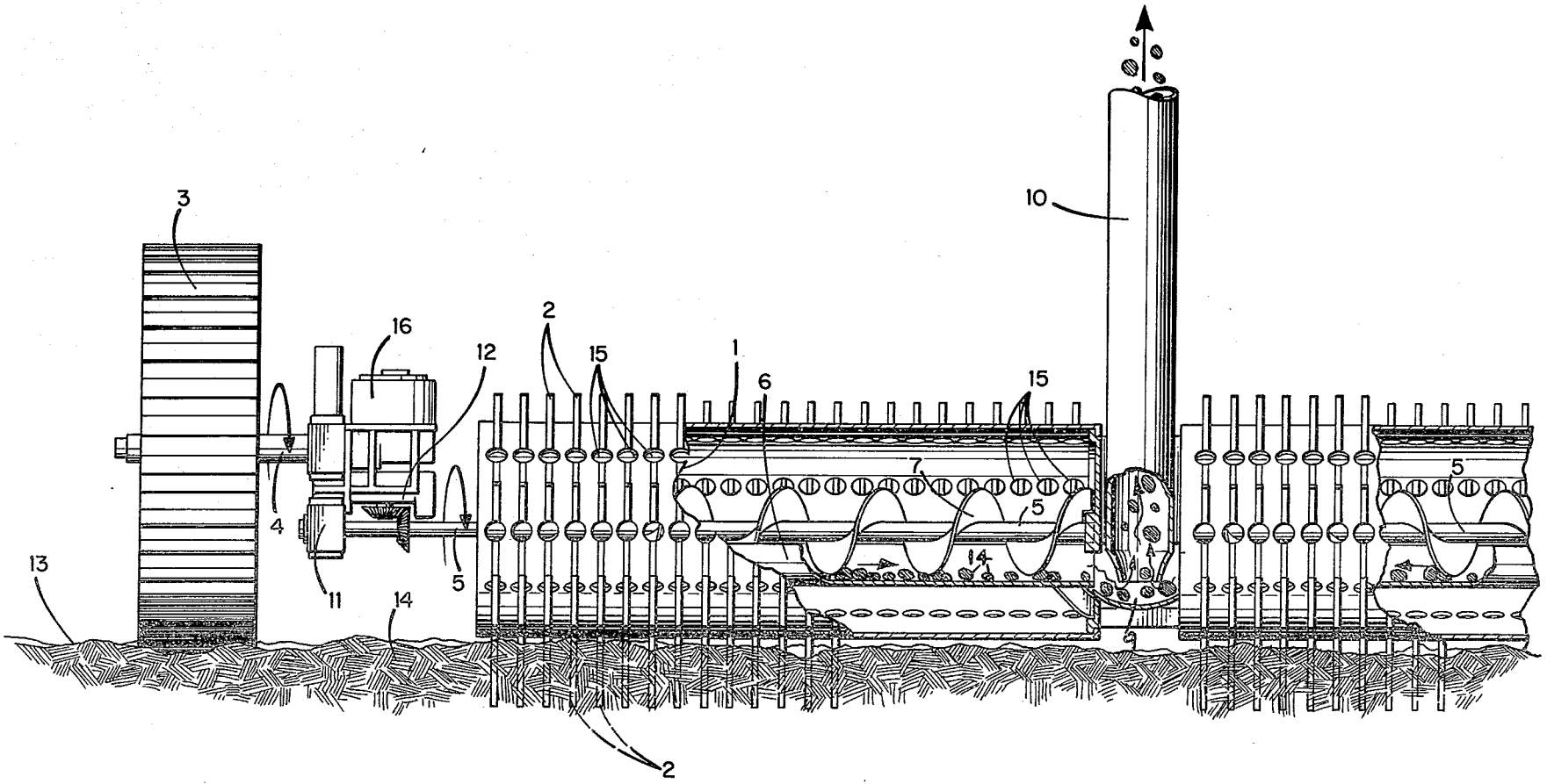
1
2
3
4
5
6
7
10
11
12
13
14
15
16

APPARATUS FOR UNDERWATER RETRIEVAL, SELECTION AND CONCENTRATION OF MATERIAL FOR OCEAN MINING

The present invention relates to apparatus for retrieval, selection and concentration of material from the ocean floor and similar areas.

Various types of systems for collecting materials from the ocean floor have heretofore been proposed and used with varying degrees of effectiveness over the years. Several typical systems for this purpose are described, for example, in U.S. Pat. Nos. 3,504,943; 3,305,950; 3,500,684; 3,554,300; 3,543,526; 3,420,576; 3,521,387; 3,470,633; 3,512,280; 3,543,422; 3,540,226; 3,576,111; and in *Ocean Industry,* Gulf Publishing Company, August 1972, pp. 34–35.

As has been well known, however, these systems have fallen short of commercially satisfactory apparatus and have generally been quite unreliable in view of the relatively large number of required moving parts and the necessity for sophisticated controls and steering mechanisms. Most of these systems, moreover, have not been adapted for depths below about 200 feet; and those particularly designed for greater depths, have either been unable to select and concentrate minerals, like manganese nodules from the ocean floor, or have been unable to operate on rough ocean bottom terrain.

An object of the present invention, accordingly, is to provide a new and improved combined bottom crawler, material retriever, selector and concentrator that largely obviates the above-described problems.

In summary, this end is achieved by a bottom crawler vehicle construction equipped with a system of wheels connected in a manner that prevents the vehicle from becoming stuck during operation, a rotating digging system which retrieves only minerals or the like within a predetermined desired size range, and a cooperative conveying system which concentrates the unit quantities of the retrieved and sized material and conveys the same to a central location where hydraulic suction transports the material to the surface.

An additional object is to provide a novel material retrieving, mining and transport system of more general application, also.

Other and further objects will be described hereinafter and are more particularly delineated in the appended claims.

This invention will now be described with reference to the accompanying drawings, the single FIGURE of which is a front elevation of a preferred embodiment, with parts broken away to illustrate details of construction.

The major parts of the bottom crawling vehicle include a cylindrical rotatable digging drum unit 1 movable, as later explained, as end wheels 3, of larger diameter than the drum 1, carry the unit over the ocean bottom 13, and equipped with successive rows or longitudinal arrays of fork-like outward extensions or inclined projections 2 for digging into the ocean floor 13 during such movement. As the successive transversely spaced rows of fork-like extensions or projections 2 dig into the ocean floor 13, in response to rotation of the drum unit 1, they loosen and retrieve particulate and other material 14 on or slightly below the ocean floor, with the spacing between the forks determining the minimum size of material to be retrieved. The inclined nature of the forks aids in minimizing resistance during the process of digging into and along the ocean floor. The loosened material 14 is carried by the rotation of the unit 1 above the ocean floor and then falls through corresponding rows of adjacent openings 15 associated with the forks, and into the interior of the cylindrical drum unit 1, thence falling into a longitudinally extending non-rotating interior trough 6. The selection of the size of the openings 15 determines and selects the maximum size of the materials retrieved As the longitudinal shaft 5 of the drum 1 rotates, as later explained, rotating the drum in the direction of the arrow thereabout, a helical or spiral screw drive 7 interiorly attached thereto will rotate within the trough 6 to concentrate and drive the retrieved material axially inward to a central region or location 9 disposed below a transport conduit or pipe 10 where the same is hydraulically pumped or otherwise picked up into the pipe and thus transported to the surface for recovery, as by well-know hydraulic systems as of the types described in the before-mentioned patents, schematically illustrated by the arrow.

The rotating digging drum unit 1 may be driven by its shaft 5, journaled in end plates 11, through a gear mechanism 12, turning in response to the drive of the shaft 4 of the outer wheels 3, as by a motor 16, or vica versa; or the system may be towed along the ocean floor 13. Such a mechanism allows the apparatus positively to move forward at a desired speed and crawl over smaller obstacles and uneven bottom features. As before stated, by the selection of the spacing of the forks 2 and the selection of the size of the openings 15 in the rotating drum unit 1 the minimum and maximum sizes of material to be mined can accurately be predetermined and selected. Through this construction and the concentrating action of the spiral screw 7 and the relative dimensions or the system, as shown, a predetermined desired concentration of material can be obtained at the pick-up location or region 9, with bottom filtering thereat automatically eliminating sand, silt or other unwanted material from entering the hydraulic transport system 10, providing high efficiency of the hydraulic recovery.

In another aspect of the invention, the bottom crawler 1 may be moved principally by a towing mechanism over the ocean floor, as before suggested, whereby a damping system of the types commonly used in oceanographic research may be attached to the towing device. The rotational movement of the digging drum 1 may either be achieved by a mechanical transmission of the towing movement, or by a separate electric or hydraulic drive such as 16.

While the invention has been described by reference to its preferred application to ocean mining, it is not so limited, being adapted for use wherever its advantages are desired, and may be thus readily adapted to other uses by those skilled in the art.

What is claimed is:

1. Apparatus for retrieval, selection and concentration of materials for mining from the ocean bottom and the like having, in combination, longitudinally rotatable drum means provided with digger means and corresponding adjacent opening means for receiving materials loosened by the digger means during rotation of the drum means over the ocean bottom, said digger means comprising a plurality of substantially longitudinally extending rows of forks spaced transversely along the drum means and said opening means comprising a corresponding plurality of adjacent rows of openings, the spacing between said forks determining the minimum size of material to be mined and the size of said openings determining the maximum size of the material to be mined; material-retrieving trough means extending longitudinally along the interior of the drum means and communicating with said opening means; drive means disposed within the trough means and rotatable with said drum means to concentrate and move the materials received in the trough means longitudinally inwardly to a pick-up region; and hydraulic conduit means disposed at said pick-up region for transporting said concentrated material upward from the bottom.

2. Apparatus as claimed in claim 1 and in which said drum means is transported over said ocean bottom by end wheels of larger diameter than the drum means.

3. Apparatus as claimed in claim 1 and in which said drive means comprises a longitudinally extending spiral screw rotatable with the drum means and within said trough means.

4. Apparatus as claimed in claim 1 and in which said trough means is relatively stationary with respect to said drive means within said drum means, and said pick-up region is provided with sand and silt removal means.

* * * * *